US008257168B2

(12) United States Patent
Kitamura

(10) Patent No.: US 8,257,168 B2
(45) Date of Patent: Sep. 4, 2012

(54) GAMING MACHINE THAT CAN MOVE CHIP BET TO ANOTHER REGION

(75) Inventor: Kenta Kitamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 329 days.

(21) Appl. No.: 12/473,650

(22) Filed: May 28, 2009

(65) Prior Publication Data

US 2010/0062839 A1 Mar. 11, 2010

Related U.S. Application Data

(60) Provisional application No. 61/096,176, filed on Sep. 11, 2008.

(51) Int. Cl.
*A63F 9/24* (2006.01)

(52) U.S. Cl. ..... 463/25; 463/36

(58) Field of Classification Search ..... 463/36, 463/37, 25

See application file for complete search history.

(56) References Cited

U.S. PATENT DOCUMENTS

| | | | | |
|---|---|---|---|---|
| 4,339,798 | A * | 7/1982 | Hedges et al. | 463/26 |
| 6,659,866 | B2 * | 12/2003 | Choo et al. | 463/17 |
| 6,776,712 | B2 * | 8/2004 | Idaka | 463/16 |
| 7,311,305 | B2 | 12/2007 | Matsuno et al. | |
| 2006/0157928 | A1 * | 7/2006 | O'Halloran | 273/142 R |
| 2006/0170154 | A1 * | 8/2006 | Matsuno et al. | 273/142 R |
| 2008/0064499 | A1 * | 3/2008 | Grant et al. | 463/36 |
| 2008/0297482 | A1 * | 12/2008 | Weiss | 345/173 |
| 2010/0087241 | A1 * | 4/2010 | Nguyen et al. | 463/17 |
| 2010/0130280 | A1 * | 5/2010 | Arezina et al. | 463/20 |
| 2011/0065513 | A1 * | 3/2011 | Nordahl et al. | 463/46 |

OTHER PUBLICATIONS

"Rules for Roulette Approved Rules as at May 20, 2003," http://www.olgc.sa.gov.au/casino/Games_and_Machines/Rules_of_Roulette_Games_021203.pdf.*

"Welcome to the Real Touch," Atronic brochure, 1999.*

U.S. Appl. No. 12/782,260, filed May 18, 2010, Kitamura, et al.

* cited by examiner

*Primary Examiner* — Matthew W Such
*Assistant Examiner* — Robert Carpenter
(74) *Attorney, Agent, or Firm* — Lexyoume IP Meister, PLLC.

(57) ABSTRACT

A gaming machine detects a player touching a bet region on which an existing bet is placed and, upon detecting that another bet region has been touched thereafter, dynamically displays a chip displayed on the bet region on which an existing bet is placed so as to move to the other bet region.

3 Claims, 16 Drawing Sheets

GAMING MACHINE THAT CAN MOVE CHIP BET TO ANOTHER REGION

CROSS REFERENCE TO RELATED APPLICATIONS

This application claims benefit of U.S. Provisional Application No. 61/096,176, filed Sep. 11, 2008, the entire contents of which are incorporated herein by reference.

BACKGROUND OF THE INVENTION

1. Field of the Invention

The present invention relates to a gaming machine that can move a chip bet to another region.

2. Related Art

Conventionally, a variety of table games has been known. For example, in a roulette game, firstly, a player places a chip on one or more bet regions among a plurality of bet regions. Then, a dealer starts rotating a roulette wheel and drops a ball in an outer side of a circumference of a roulette wheel. Then, the ball rolls along the circumference of the roulette wheel and subsequently drops in a pocket among a plurality of pockets provided on the circumference of the roulette wheel. Identification numbers from "0" to "36" are assigned to each of the plurality of pockets and, in a case in which a bet region on which a chip is placed corresponds to the identification number assigned to the pocket in which a ball drops, a player can win an award.

Among roulette games, for example, as disclosed in U.S. Pat. No. 7,311,305, a roulette game has been known in which a display for displaying an image is used so as to artificially perform an operation of placing a chip on a bet region.

However, in a gaming machine that artificially performs an operation of placing a chip on a bet region, in a case of moving a chip once placed on a bet region to another bet region, a bet operation that has already been performed has to be cancelled and a bet operation has to be performed again. For this reason, there has been a problem in that, in the gaming machine that artificially performs an operation of placing a chip on a bet region, an operation to cause a chip once placed on a bet region to move to another region is bothersome.

It is an object of the present invention to provide a gaming machine which overcomes the trouble of an operation to move a chip bet to another region.

SUMMARY OF THE INVENTION

According to a first aspect of the invention, a gaming machine is provided which includes: a display that displays an image; memory that stores data relating to a bet; and a controller that executes the following processing of: (a) displaying a plurality of bet regions on the display; (b) in response to having detected a player touching a first bet region among the plurality of bet regions, displaying a chip on the first bet region; (c) storing in the memory data indicating that a bet has been placed on the first bet region; (d) detecting that the player has touched the chip displayed on the first bet region; (e) detecting that the player has touched a second bet region; (f) dynamically displaying the chip displayed on the first bet region so as to move from the first bet region to the second bet region; and (g) updating from data indicating that a bet has been placed on the first bet region to data indicating that a bet has been placed on the second bet region.

According to the first aspect of the present invention, the player can move a chip once bet to another region by only touching a chip displayed in the first bet region, and then touching the second bet region. Thus, a gaming machine can be provided that overcomes a trouble of an operation to move a chip once bet to another region.

According to a second aspect of the present invention, the gaming machine according to the first aspect further includes a timer that measures a time starting from reception of a bet, in which the controller executes the processing (a) through (g), while the timer measures a predetermined time.

According to the second aspect of the present invention, while the timer measures a predetermined time, the player can move a chip once bet to another region as many times as the player wants, by only touching a chip displayed in the first bet region, and then touching the second bet region.

According to a third aspect of the present invention, in a gaming machine according to the first aspect, after the processing (d), the controller detects the player continuously touching from the chip displayed on the first bet region to the second bet region, and dynamically displays the chip so as to move along a touching path thus detected.

According to the third aspect of the present invention, there is a difference in that a chip is moved artificially using the cancel button or the like, and an operation to move a chip once placed for betting to another region can be performed as if an actual chip is caused to move. Thus, a gaming machine can be provided that overcomes a trouble of an operation to move a chip once bet to another region.

DETAILED DESCRIPTION OF THE INVENTION

Embodiments of the present invention are described below with reference to the accompanying drawings.

Figure 1:
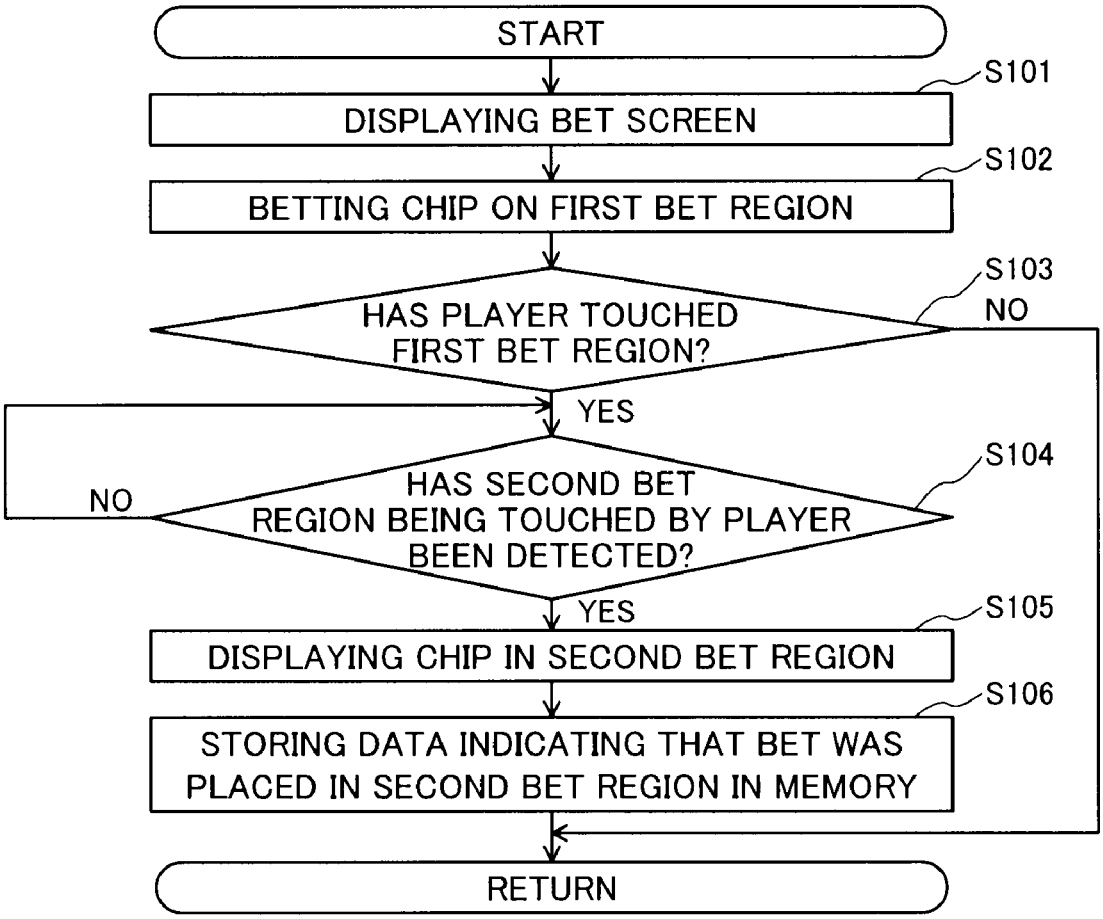
FIG. 1 is a flowchart schematically showing bet processing executed in a gaming machine according to an embodiment of the present invention.

As described in detail later, a gaming machine 13 according to the present invention includes a liquid crystal display 30 that displays an image, RAM 110 that stores data indicating a bet has been performed, and a CPU 106 that executes subsequent bet processing. As shown in FIG. 1, the CPU 106 displays a bet screen on the liquid crystal display 30 (Step S101). Then, the CPU 106 bets a chip in a first bet region among a plurality of bet regions in response to detection of a bet operation by a player (Step S102).

Then, the CPU 106 determines whether the first bet region being touched by the player has been detected (Step S103). In a YES determination, the CPU 106 determines whether the second bet region being touched by the player has been detected (Step S104). On the other hand, in a NO determination, the CPU 106 ends the bet processing.

In a YES determination in Step S104, the CPU 106 displays a chip on the second bet region (Step S105). On the other hand, in a NO determination in Step S104, the CPU 106 repeats the processing of Step S104.

In response to the processing of Step S105, the CPU 106 stores in RAM 110 the data indicating that a chip was bet in the second bet region (Step S106). In response to the processing of Step S106, the CPU 106 ends the bet processing.

Figure 2:
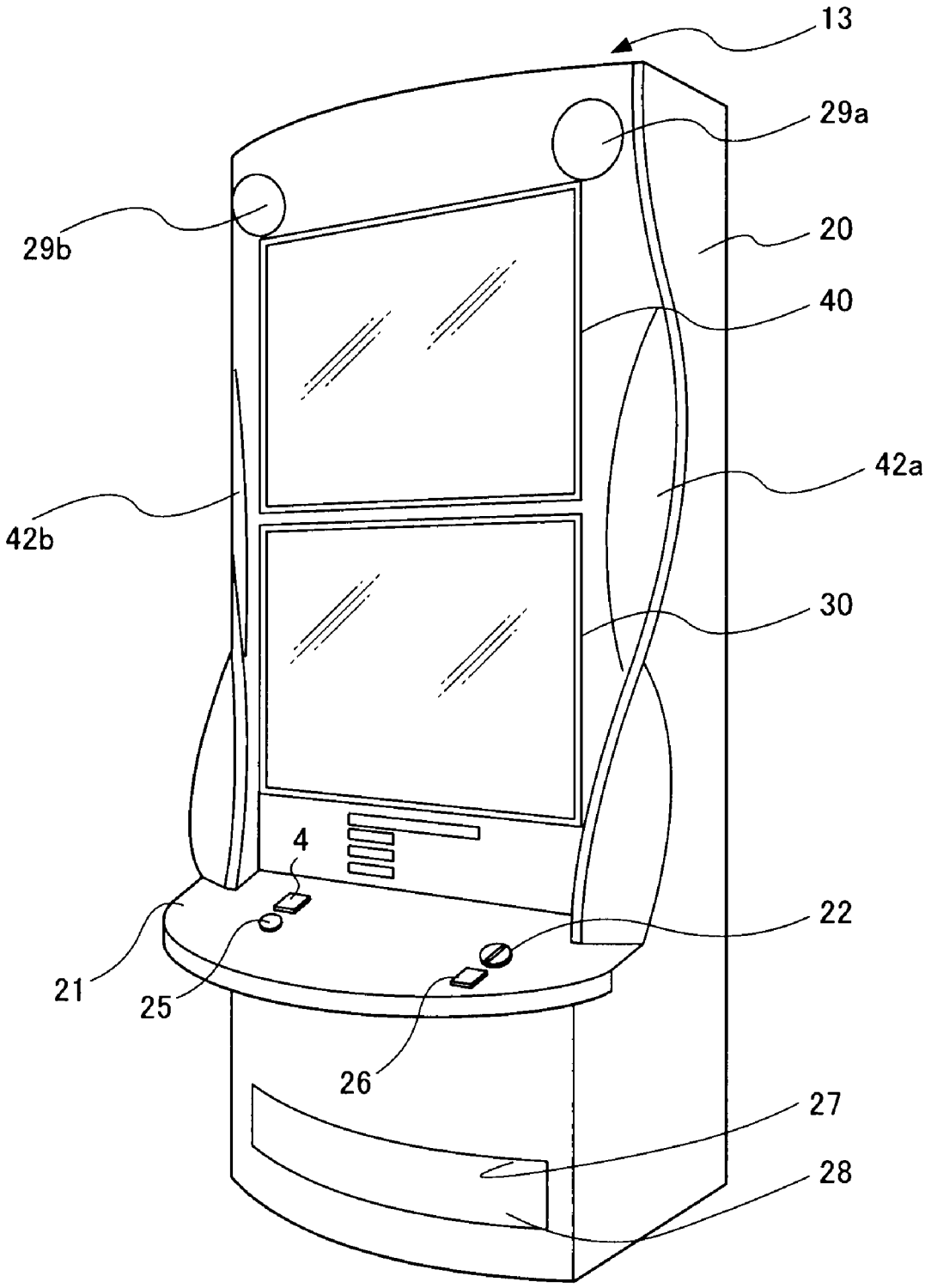
FIG. 2 is a perspective view of a gaming machine according to an embodiment of the present invention.

FIG. 2 is a perspective view showing the gaming machine 13 according to an embodiment of the present invention. The gaming machine 13 includes a cabinet 20. A face of the cabinet 20 that faces the player is opened. The cabinet 20 contains various components including a game controller 100 (refer to FIG. 3) for electrically controlling the gaming machine 13, and a hopper 44 (refer to FIG. 5) for controlling the insertion, storage, and payout of coins (game medium), and the like. The game medium is not limited to coins and medals, tokens, electronic money or electronic value information (credit) corresponding to these, for example, can be exemplified as the game medium.

The liquid crystal display 30 is installed substantially in the middle of the front face of the cabinet 20, and the liquid crystal display 40 is installed in an upper side of the cabinet 20.

Figure 11:
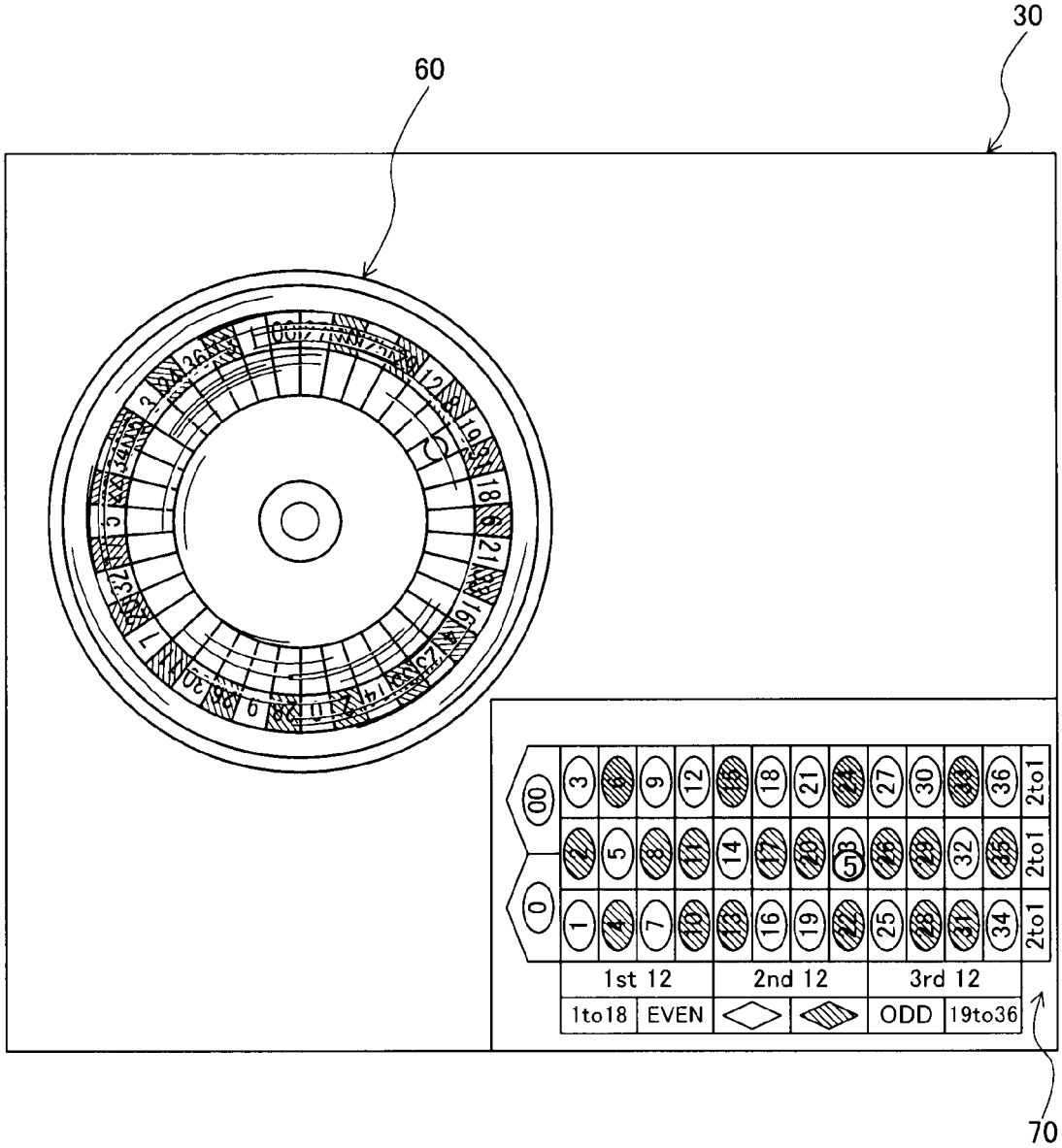
FIG. 11 is a view showing an example of a display screen of a roulette game displayed in a gaming machine according to an embodiment of the present invention.

The liquid crystal display 30 realizes a display device for displaying a variety of images related to the game including rendered images and the like. Such a configuration allows the player to advance the game while visually confirming various kinds of images displayed on the aforementioned liquid crystal display 30. For example, the liquid crystal display 30 displays a roulette game as shown in FIG. 11 described later.

The other liquid crystal display 40, which is above the liquid crystal display 30, is a display functioning as a sub display for displaying the rules of the game, demonstration screens, and the like.

Sound transmission openings 29*a* and 29*b* are provided to both upper left and right sides of the liquid crystal display 40 in order to transmit sound effects generated by a speaker 41 (see FIG. 3) stored within the cabinet 20. The sound transmission openings 29*a* and 29*b* generate sound effects and the like in accordance with the progress of the game. In addition, decorative lamps 42*a* and 42*b* are disposed on the right and left sides substantially in the middle of the gaming machine 13, respectively. The decorative lamps 42*a* and 42*b* emit light in accordance with the progress of the game.

The gaming machine 13 includes a substantially horizontal operation unit 21 below the liquid crystal display 30. A coin insertion slot 22, which is for inserting coins into the gaming machine 13, is provided on the right side of the operation portion 21. On the other hand, a start switch 25 that accepts a player's operation for starting a game for each game is disposed on the left side of the operation portion 21. A pushing operation on the start switch 25 triggers a roulette game.

Furthermore, a cash-out switch 26 is provided near the coin insertion opening 22. Upon the player pushing the cash-out switch 26, the inserted coins are paid out from a coin payout opening 27 provided at a lower portion of the front face. The coins thus paid out are retained in a coin tray 28.

Figure 3:
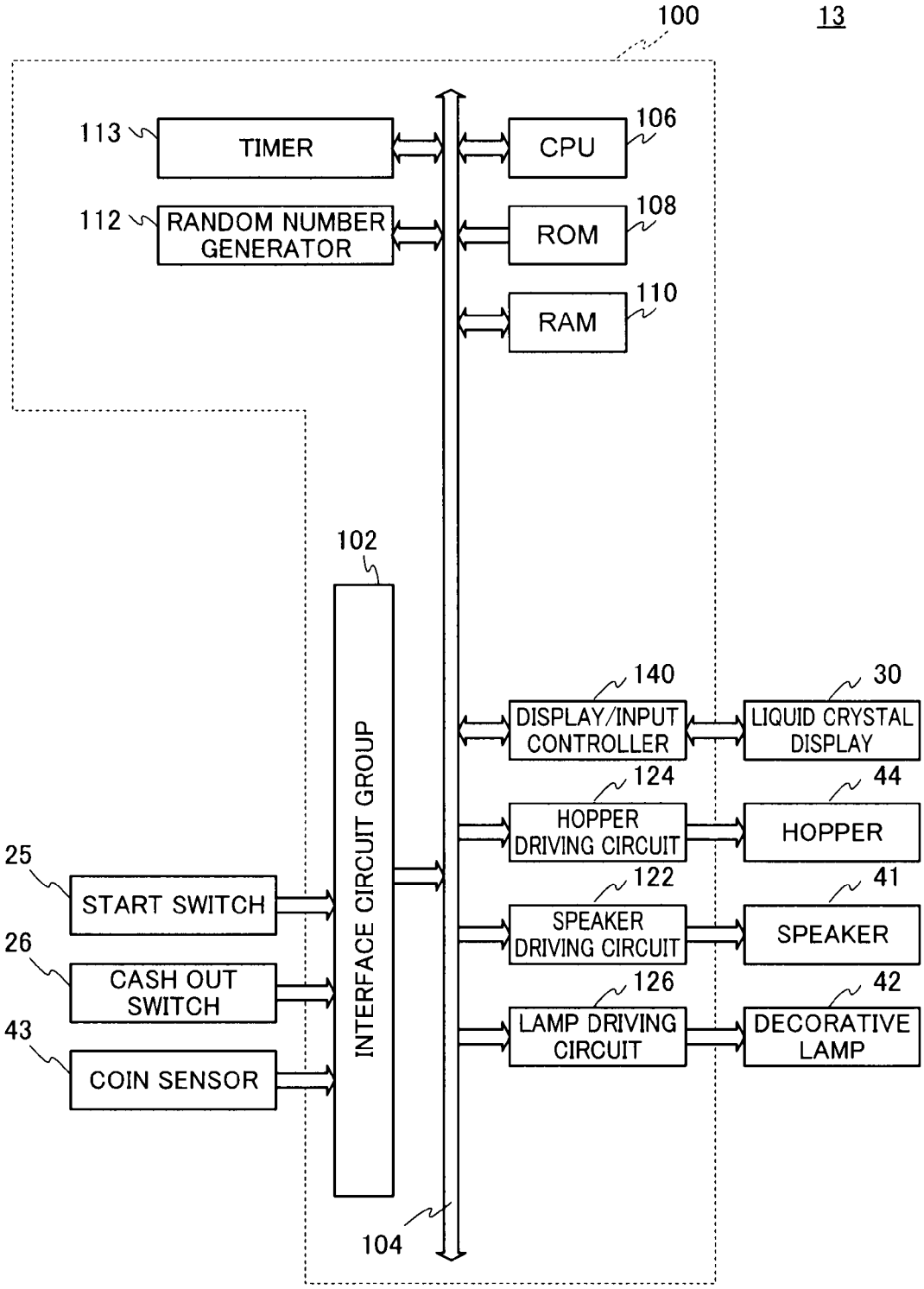
FIG. 3 is a block diagram showing an internal configuration of the gaming machine in FIG. 2.

FIG. 3 is a block diagram showing the electrical configuration of the game controller 100 of the gaming machine 13. As shown in FIG. 3, the game controller 100 of the gaming machine 13 is a microcomputer provided with an interface circuit group 102, an input-output bus 104, a CPU 106, ROM 108, RAM 110, a random number generator 112, a timer 113, a speaker driving circuit 122, a hopper driving circuit 124, a lamp driving circuit 126, and a display/input controller 140.

The interface circuit group 102 is electrically connected with the input/output bus 104, which carries out input and output of data signals or address signals for the CPU 106.

The start switch 25 is electrically connected with the interface circuit group 102. In the interface circuit group 102, a start signal generated by the start switch 25 is converted into a predetermined form of signal to be supplied to the input/output bus 104.

The cash-out switch 26 is electrically connected with the interface circuit group 102. The switching signal outputted from this cash-out switch 26 is also supplied to the interface circuit group 102, and is converted into a predetermined signal by the interface circuit group 102. The switching signals thus converted are supplied to the input/output bus 104.

A coin sensor 43 is also electrically connected to the interface circuit group 102. The coin sensor 43 is a sensor for detecting coins that have been inserted into the coin insertion slot 22, and is disposed at an appropriate position relative to the coin insertion slot 22. The sensing signal output from the coin sensor 43 is also supplied to the interface circuit group 102, and after converting thereof into a predetermined signal by the interface circuit group 102, is supplied to the input/output bus 104.

The CPU 106, the ROM 108, and the RAM 110 are connected to the input-output bus 104.

Upon accepting the start operation of a game through the start switch 25, the CPU 106 reads a game program to execute the game. The game program displays a bet screen (described later in FIGS. 8 to 10) on the liquid crystal display 30 through the display/input controller 140 and allows the player to designate a bet region and bet number. Upon completing the designation, an image of a roulette wheel rotating (described later in FIG. 11) is displayed on the liquid crystal display 30.

Figure 5:
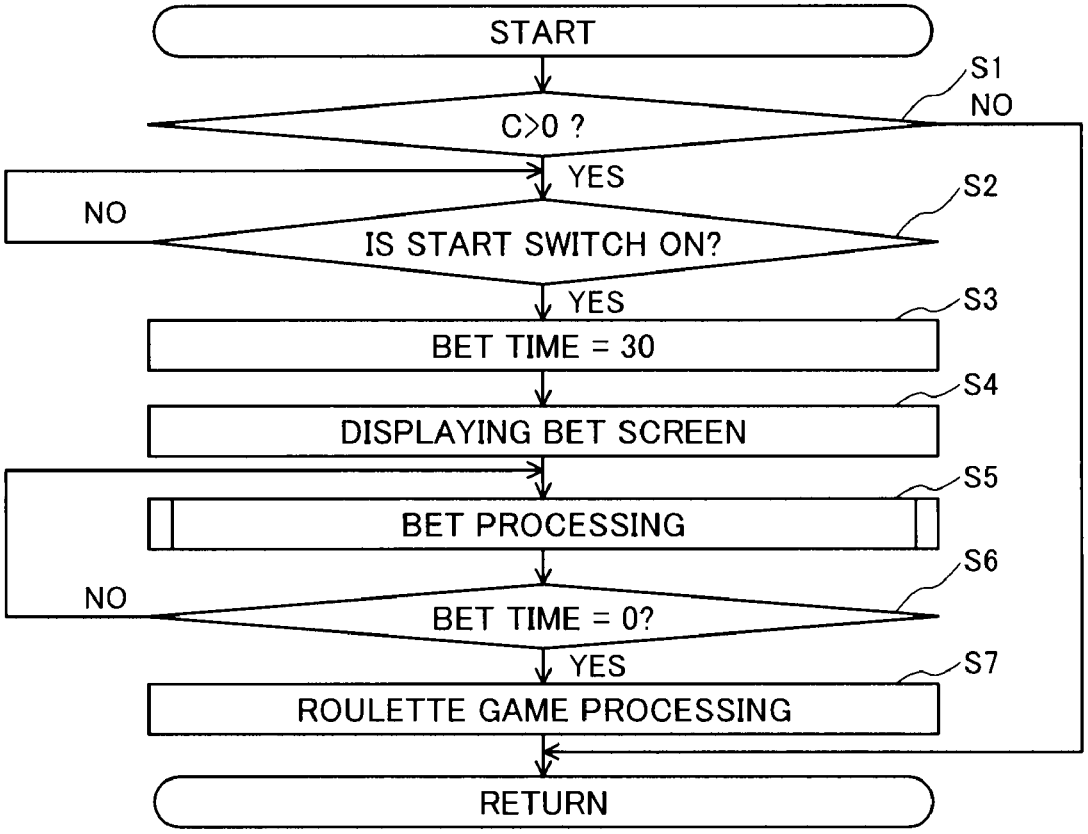
FIG. 5 is a flowchart of a control program for overall control of a gaming machine according to an embodiment of the present invention.
Figure 6:
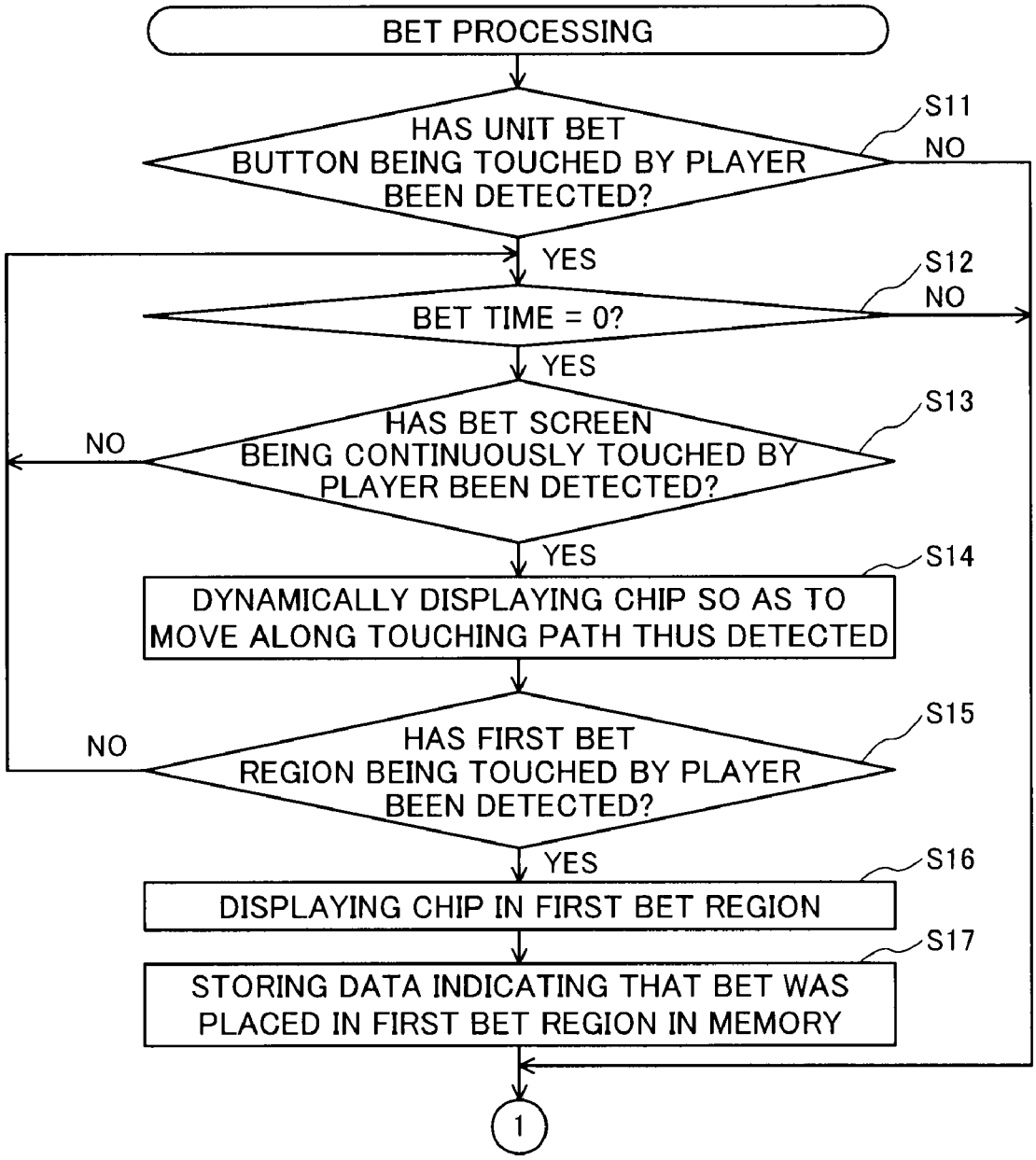
FIGS. 6 and 7 are flowcharts showing bet processing which is one routine execution program executed in a gaming machine according to an embodiment of the present invention.
Figure 7:
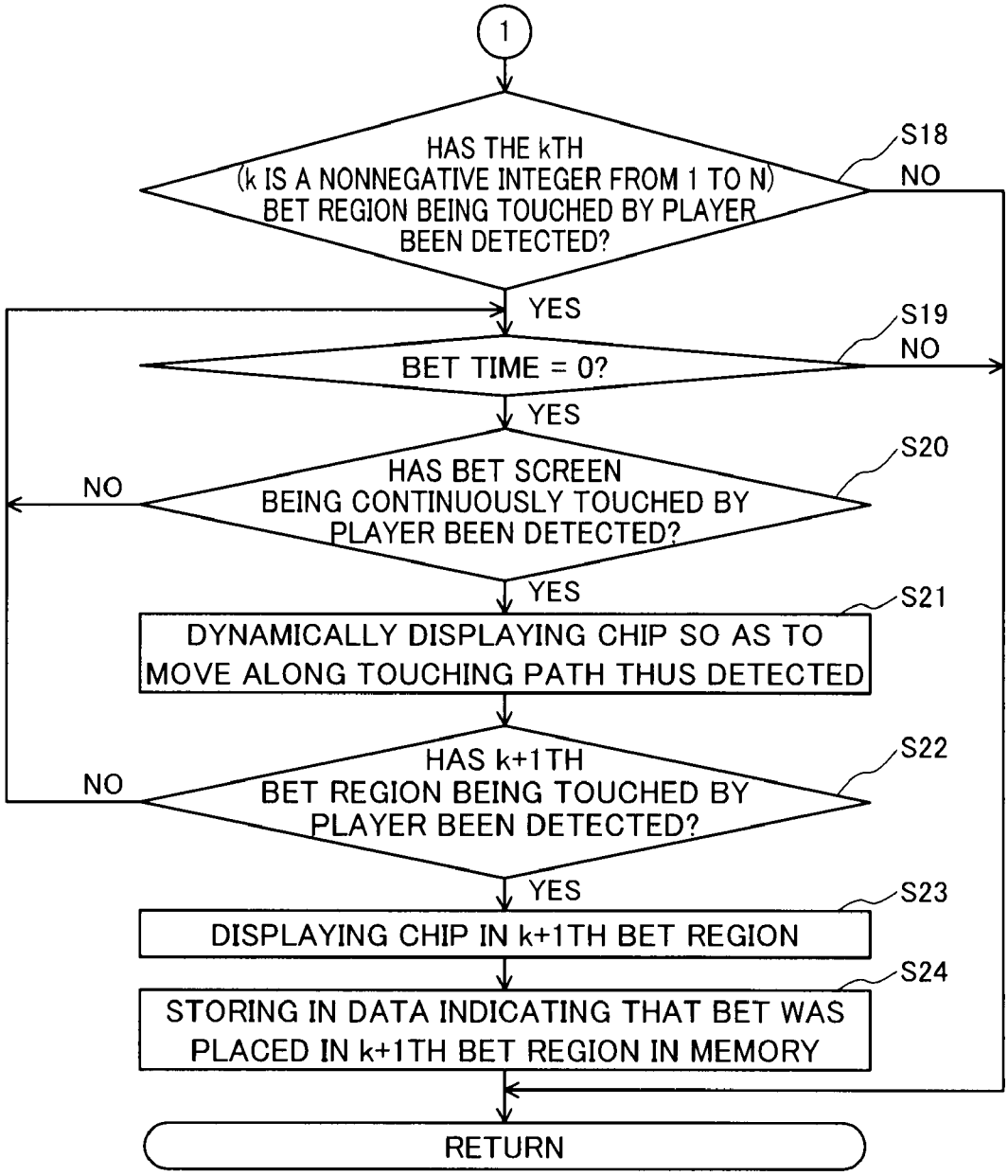

The ROM 108 stores a control program for governing and controlling the gaming machine 13 (described later in FIG. 5), a program for executing routines as shown in FIGS. 6 and 7 (hereinafter referred to as a "routine execution program"), and initial data for executing the control program, and various data tables used in determination processes. The RAM 110 temporarily stores flags, variables, etc. used for the aforementioned control program.

The random number generator 112 for generating a random number is connected to the input/output bus 104. The random number generator 112 generates random numbers in a predetermined range of "0" to "65535" (the sixteenth power of two minus one), for example. Alternatively, an arrangement may be made in which the CPU 106 generates a random number by computation.

A timer 113 is also connected to the input/output bus 144. The timer 113 measures the amount of time after starting acceptance of a bet. More specifically, the timer 113 measures an elapsed time after the CPU 106 displays a bet screen on the liquid crystal display 30. In the present embodiment, the CPU 106 ends accepting a bet when 30 seconds lapse after displaying a bet screen, and displays an image of a roulette wheel rotating on the liquid crystal display 30.

The speaker driving circuit 122 for driving the speakers 41 is also electrically connected with the input/output bus 104. The CPU 106 reads the sound data stored in the ROM 108, and transmits the sound data thus read to the speaker driving circuit 122 via the input/output bus 104. In this way, the speakers 41 generate predetermined sound effects.

The hopper driving circuit 124 for driving the hopper 44 is also electrically connected to the input/output bus 104. Upon receiving a cash-out signal input from the cash-out switch 26, the CPU 106 transmits a driving signal to the hopper driving circuit 124 via the input/output bus 104. Accordingly, the hopper 44 pays out coins such that the amount thereof is equivalent to the current number of coins remaining as credits, which is stored in a predetermined memory area of the RAM 110.

Alternatively, the payout of the coins may be performed in the form of credit data stored in a data card or the like, instead of using physical coins. That is, the player may carry a card functioning as a recording medium, and store the data related to the credit by inserting the card into the gaming machine 13.

The lamp driving circuit 126 for driving the decorative lamps 42*a* and 42*b* is also connected with the input/output bus 104. The CPU 106 transmits the signal for driving the lamps according to the predetermined conditions based on the program stored in the ROM 108 to the lamp driving circuit 126. Thus, decorative lamps 42*a* and 42*b* blink and the like.

The display/input controller 140 is also connected to the input/output controller 140. The CPU 106 creates an image display command corresponding to the state and results of the game, and outputs the image display command thus created to the display/input controller 140 via the input/output bus 104. Upon receiving the image display command input from the CPU 106, the display/input controller 140 creates a driving signal for driving the liquid crystal display 30 according to the image display command thus input, and outputs the driving signal thus created to the liquid crystal display 30. As a result, a predetermined image is displayed on the liquid crystal display 30. The display/input controller 140 transmits the signal, which is an input received by the touch panel 32 on the liquid crystal display 30, to the CPU 106 via the input/output bus 104 in the form of an input signal.

Figure 4:
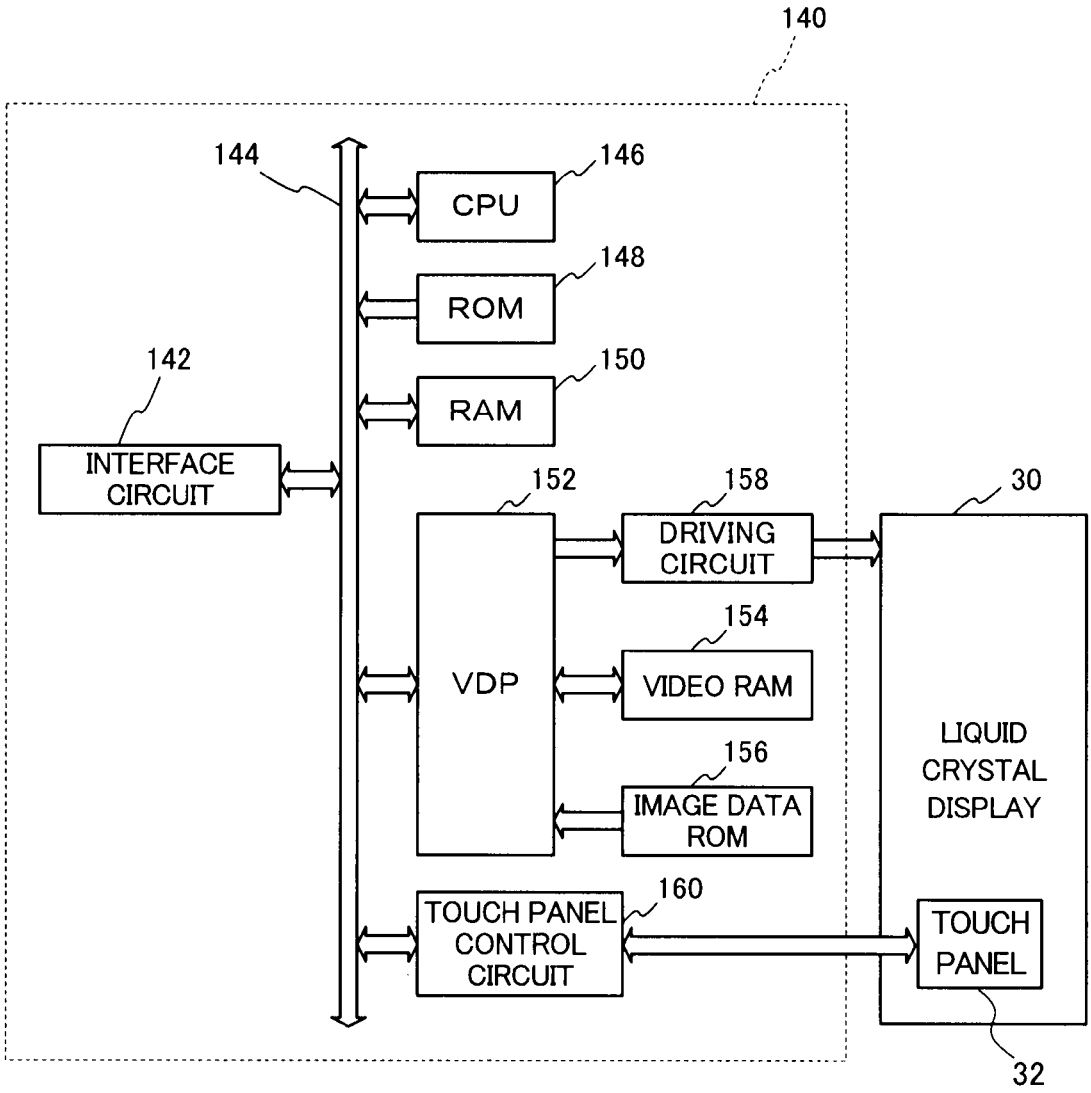
FIG. 4 is a block diagram showing an internal configuration of a display/input controller in the gaming machine shown in FIG. 2.

FIG. 4 is a block diagram showing the electrical configuration of the display/input controller 140 of the gaming machine 13. The display/input controller 140 of the gaming machine 13 is a sub-micro computer which performs image display processing and the control of input from the touch panel 32, and has an interface circuit 142, an input/output bus 144, CPU 146, ROM 148, RAM 150, VDP 152, video RAM 154, ROM 156 for image data, a driving circuit 158, and a touch panel control circuit 160.

The interface circuit 142 is connected to the input/output bus 144. An image display instruction outputted from the CPU 106 on the abovementioned game controller 100 is supplied to the input/output bus 144 via the interface circuit 142. The input/output bus 144 performs input/output of data signals or address signals with the CPU 146.

The ROM 148 and the RAM 150 are connected to the input/output bus 144. The ROM 148 stores a display control program for generating the drive signal to be supplied to the liquid crystal display 30, based on the image display command from the CPU 106 on the game controller 100. On the other hand, the RAM 150 stores flags and variables used in the aforementioned display control program.

The VDP 152 is connected to the input/output bus 144. The VDP 152 includes a so-called sprite circuit, a screen circuit, a palette circuit, etc., and can perform various kinds of processing for displaying images on the liquid crystal display 30. The video RAM 154 and the ROM 156 are connected to the VDP 152. The video RAM 154 stores image data based on the image display instructions from the CPU 106 on the game controller 100. The ROM 156 for image data stores various kinds of image data containing the abovementioned produced image data. Furthermore, the driving circuit 158 for outputting a driving signal for driving the liquid crystal display 30 is connected to the VDP 152.

The CPU 146 reads and executes the display control program stored in the ROM 148, whereby the video RAM 154 stores image data to be displayed on the liquid crystal display 30 in response to the image display command from the CPU 106 on the game controller 100. Examples of the image display commands include various kinds of image display commands including the aforementioned image display commands for visual effects, etc.

The image data ROM 156 stores various kinds of image data including the aforementioned image data for visual effects, etc.

The touch panel control circuit 160 transmits the signals, which are inputs received by the touch panel 32 on the liquid crystal display 30, to the CPU 106 via the input/output bus 144 in the form of an input signal.

FIG. 5 is a flowchart, which shows a flow of the processing operation of the gaming machine 13, is executed by the game controller 100 of the gaming machine 13. The processing operation is called from a main program for the slot machine 13 at a predetermined timing, and then executed.

In the following, supposing that the gaming machine 13 is activated in advance and the variables used in the CPU 106 on the game controller 100 are initialized to predetermined values, respectively, the gaming machine 13, as a result of this, will be operating normally.

Firstly, the CPU 106 on the game controller 100 determines whether any credits, which correspond to the remaining amount of coins inserted by the player, remain (Step S1). More specifically, the CPU 106 reads the amount of credits C stored in the RAM 110, and executes processing according to the amount of credits C. When the amount of credits C equals "0" (a NO determination in Step S1), the CPU 106 terminates the routine without executing any processing, since it cannot start a game. When the amount of credits C is not less than "1" (a YES determination in Step S1), the CPU 106 determines that coins remain as credits, and the CPU 106 advances the processing to Step S2.

In Step S2, the CPU 106 determines whether the start switch 25 is ON, and waits for the start switch 25 to be operated. Upon the start switch 25 being operated, and accordingly, upon an operation signal being input from the start switch 25 (in a case of a YES determination in Step S2), the CPU 106 determines that the start switch 25 has been operated, and advances the processing to Step S3.

In Step S3, the CPU 106 sets the bet time to "30" by setting the timer 113 to "30". The timer 113 decrements by "1" with every 1 second that elapses.

In Step S4, the CPU 106 displays a bet screen (see FIGS. 8 to 10) on the liquid crystal display 30. In Step S5, the CPU 106 performs bet processing, which is described later with reference to FIGS. 6 and 7.

In Step S6, the CPU 106 determines whether the bet time is "0" or not by determining whether the timer 113 is "0" or not. Along with this, in a case in which the CPU 106 determines that the bet time is "0" (in a case of a YES determination in the processing of Step S6), the CPU 106 performs roulette game processing (Step S7) and ends the present routine. For example, as shown in FIG. 11, in the roulette game processing, the CPU 106 displays an image in which a roulette game is performed on the liquid crystal display 30. On the other hand, in a case in which the CPU 106 determines that the bet time is not "0" (in a case of a YES determination in the processing of Step S6), the CPU 106 returns the processing to Step S5.

FIGS. 6 and 7 are flowcharts showing flows of bet processing.

A bet screen according to an embodiment of the present invention is described with reference to FIG. 8, which illustrates a flow of bet processing.

Figure 8:
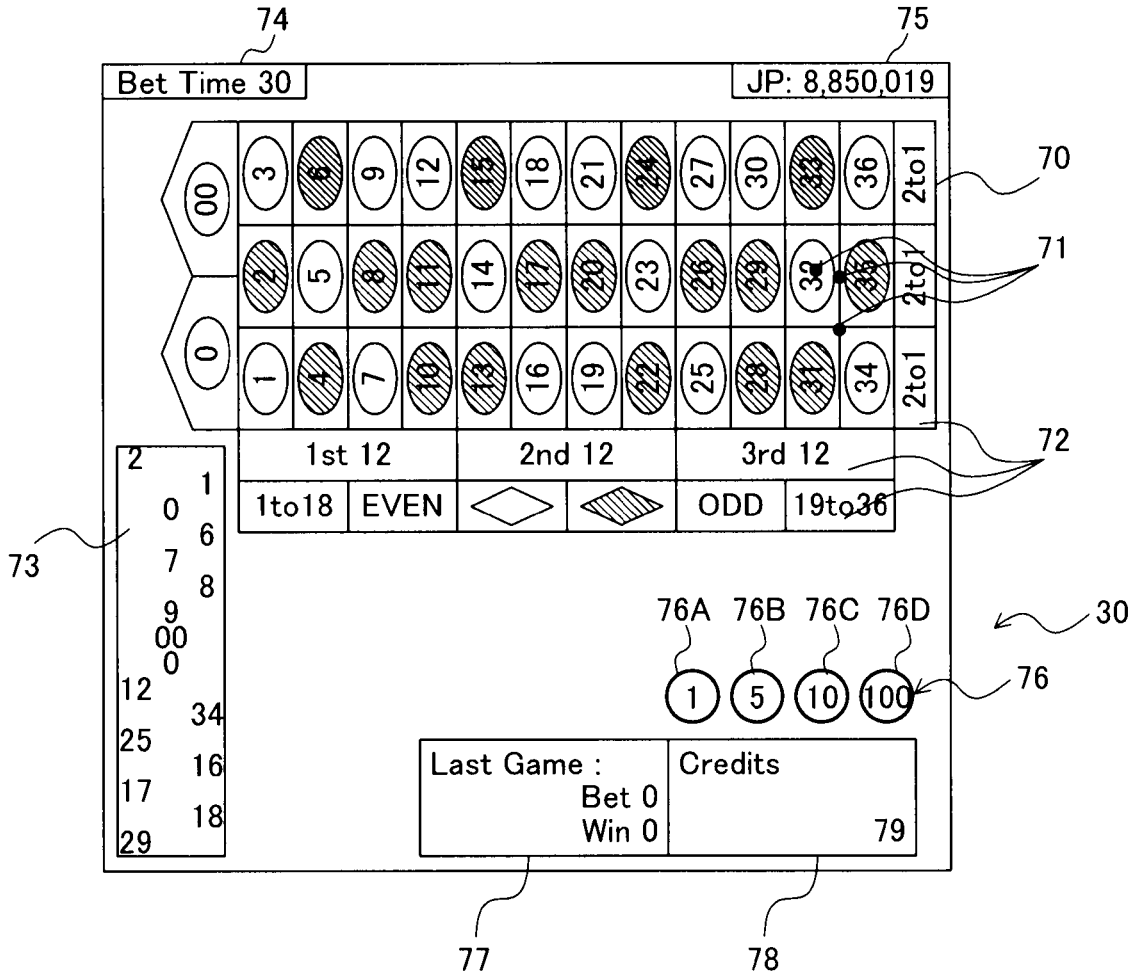
FIGS. 8 to 10 are views showing an example of a bet screen displayed in a gaming machine according to an embodiment of the present invention.

FIG. 8 is an enlarged view of a display region in the liquid crystal display 30 of the gaming machine 13. In the liquid crystal display 30, a betting board 70 is displayed. A plurality of bet regions 71 for betting credits is displayed on the betting board 70. In the bet regions 71, 38 numerals of "0", "00", and "1" through "36" are aligned and displayed in boxes.

For example, as shown in FIG. 8, in a case in which a chip is placed on a box "32", betting a chip on a single number "32" is indicated. Such a betting method is called "Straight-up bet".

Furthermore, in a case in which a chip is placed on a line between boxes "32" and "35", betting a chip on two numbers "32" and "35" is indicated. Such a betting method is called a "Split-bet".

In a case in which a chip is placed at the intersection of the lines between the boxes "31", "32", "34", and "35", betting a chip on four numbers "31", "32", "34", and "35". Such a betting method is called a "Corner-bet".

Furthermore, special bet regions 72, which allow a player to bet on "odd numbers", "even numbers", "the color of the numbers display plate 64 (red or black)", "a predetermined range of numbers (e.g., "1" to "12")", are arranged similarly in a grid form.

For example, in a case in which a chip is placed at a box in which "EVEN" is depicted, this indicates that a chip is bet on odd number. Such a betting method is called "Even".

Furthermore, in a case in which a chip is placed at a box in which "ODD" is depicted, this indicates that a chip is bet on even number. Such a betting method is called "Odd".

Furthermore, in a case in which a chip is placed at a box in which red diamond is depicted, betting a chip on boxes with a red color is indicated. Such a betting method is called "Red".

In a case in which a chip is placed in a box in which black color diamond is depicted, betting a chip so as to cover boxes with a black color is indicated. Such a betting method is called "Black".

In a case in which a chip is placed in a box in which "1st 12", "2nd 12", or "3rd 12" is depicted, betting a chip so as to cover 12 numbers is indicated, respectively. Such a betting method is called "Dozen Bets".

In a case in which a chip is placed in a box in which "1 to 18" or "19 to 36" is written, betting a chip so as to cover 18 numbers according to whether the number is no more than 18 or at least 19 is indicated. Such a betting method is called "1 to 18/19 to 36".

In a case in which a chip is placed in a box in which "2 to 1" is written, betting a chip so as to cover 12 numbers of each column including numbers such as "1", "4", "7" . . . is indicated. Such a betting method is called "Column bet".

Other bet methods are "Street bet", which places a bet on the end of a horizontal row of number so as to cover 3 numbers (e.g., "13", "14", and "15"); "Five bet", which places a bet on a line between the numbers "00" and "13" so as to cover the five numbers "0", "00", "1", "2", and "3"; and "Line bet", which places a bet between two horizontal rows of numbers so as to cover 6 numbers (e.g., "13", "14", "15", "16", "17", and "18").

The abovementioned bet methods have awarded credits per one chip when a chip bet has won (payout rate) that are respectively different.

A result history display unit 73 is displayed on the left side of the betting board 70. The result history display unit 73 displays the results of the winning numbers of the past games up to the previous game in the form of a list. The term "one game" as used here represents a series of operations from a stage in which the player places a bet in the gaming machine 13, up to a stage in which the player plays a roulette game. With such an arrangement, upon completion of one game, a new winning number is added to the top field of the list, which has a capacity to allow the players to confirm the history of the winning numbers of a maximum of 16 games.

A bet time display unit 74 is provided at an upper portion of the betting board 70. The bet time display unit 74 displays time remaining during which the player can place bets. For example, the bet time display unit 74 displays the time remaining "30" at the start time for receiving bets. Then, the time remaining displayed by the bet time display unit 74 is reduced in decrements of 1 for each second. Upon the time remaining becoming zero, the period for receiving bets expires.

Furthermore, a JP (Jack Pot) display unit 75 for displaying the amount of credits accumulated up to the current point in time is provided on the right side of the bet time display unit 74. Here, the JP display unit 75 displays the amount of credits obtained as 0.5% of the accumulated credits up to the previous game. In the case that a predetermined condition has been satisfied in a jackpot bonus game that occurs at a certain timing, the player wins in the jackpot bonus game, and the credit amount for the jackpot is paid out, whereupon the JP display unit 75 displays an initial value (e.g., 50,000 credits) after the payout.

Unit bet buttons 76 are provided at the lower part of the betting board 70. The bet unit buttons 76 are provided for allowing the player to place bets using chips on the bet regions 71 and 72 (a box having a number and mark, or a line which defines the boxes) specified by the player. The bet button 76 is composed of a 1 bet button 76A, a 5 bet button 76B, a 10 bet button 76C, and a 100 bet button 76D. A player can bet chips by pushing any one of the unit bet buttons 76 directly such as by a finger, and continuously pushing the unit bet button 76 until a bet region 71 or 72 where the player wants to bet.

The present invention is not restricted to such an arrangement in which the chips are bet on one location. After pushing any one of the unit bet buttons 76, by continuing to push the unit bet button 76 until a bet region 71 or 72 where the player wants to bet, a plurality of bet operations becomes possible.

A payout number display unit 77 is provided at a lower part of the unit bet buttons 76. The payout number display unit 77 displays the amount of chips bet in the previous game and the number of credits paid out. Here, a number obtained by subtracting the amount bet from the number of credits paid out is the number of credits which the player has newly acquired by the previous game. This display example shows a day's first instance of a roulette game in the gaming machine 13, so the amount bet and the payout credits both show "0".

Furthermore, a credit amount display unit 78 is provided at the right side of the payout number display unit 77. A credit amount display unit 78 displays the amount of credits which the player currently has. This credit amount decreases as chips are bet (one credit for one bet). In addition, in a case where a chip bet has won, and pay out of credits is done, a number of credits of a paid out amount is added. It should be noted that, in the event that the number of credits which the player has becomes zero, the game is over. In this display example, "79" is displayed as the credit amount.

With reference to FIGS. 6 and 7 again, a flowchart showing a flow of bet processing is described.

Firstly, the CPU 106 determines whether any one of the unit bet buttons 76 being touched by the player has been detected (Step S11). In a case in which any one of the unit bet buttons 76 has been detected being touched by the player (in a case of a "YES" determination in Step S11), the CPU 106 advances the processing to Step S12. On the other hand, in a case in which any one of the unit bet buttons 76 has not been detected being touched by the player (in the case of a "NO" determination in Step S11), the CPU 106 advances the processing to Step S18 of FIG. 18.

In Step S12, the CPU 106 determines whether the bet time is "0" or not. In a case in which the CPU 106 determines that the bet time is "0" (in the case of a YES determination in the processing of Step S12), the CPU 106 advances the processing to Step S13. On the other hand, in a case in which the CPU 106 determines that the bet time is not "0" (in the case of a NO determination in the processing of Step S12), the CPU 106 advances the processing to Step S18 of FIG. 7.

In Step S13, the CPU 106 determines whether the bet screen has been detected being continuously touched by the player. In a case in which the bet screen has been detected being continuously touched by the player (in the case of a YES determination in Step S13), the CPU 106 advances the processing to Step S14. On the other hand, in a case in which the bet screen has not been detected being continuously touched by the player (in the case of a NO determination in the processing of Step S13), the CPU 106 advances the processing to Step S12.

In Step S14, the CPU 106 dynamically displays a chip so as to move along the touching path thus detected in the processing in Step S13.

In Step S15, the CPU 106 determines whether the first bet region (either one bet region among a plurality of the bet regions 71 and 72) has been detected being touched by the player. In a case in which the first bet region has been detected being touched by the player (in the case of a YES determination in Step S15), the CPU 106 advances the processing to Step S16. On the other hand, in a case in which the first bet region has not been detected being touched by the player (in the case of a NO determination in Step S15), the CPU 106 advances the processing to Step S12.

In Step S16, the CPU 106 displays a chip in the first bet region.

In Step S17, the CPU 106 stores in the memory the data indicating that a bet is placed on the first bet region, and advances the processing to Step S18 of FIG. 7.

In Step S18 of FIG. 7, the CPU 106 determines whether the $k^{th}$ (k is a nonnegative integer from 1 to n) bet region (a bet region different from the $k-1^{th}$ bet region among a plurality of bet regions 71 and 72) has been detected being touched by the player. In a case in which the $k^{th}$ bet region has been detected being touched by the player (in the case of a YES determination in the processing of Step S18), the CPU advances the processing to Step S19. On the other hand, in a case in which the $k^{th}$ bet region has not been detected being touched by the player (in the case of a NO determination in the processing of Step S18), the CPU 106 ends the bet processing, and advances the processing to Step S6 of FIG. 5.

In Step 19, the CPU 106 determines whether the bet time is "0" or not. In a case in which the bet time is determined to be "0" (in the case of a YES determination in the processing of Step S19), the CPU 106 advances the processing to Step S20. On the other hand, in a case in which the bet time is determined not to be "0" (in the case of a NO determination in the processing of Step S19), the CPU 106 returns the processing to Step S6 of FIG. 5.

In Step S20, the CPU 106 determines whether the bet screen has been detected being continuously touched by the player. In a case in which the bet screen has been detected being continuously touched by the player (in the case of a YES determination in the processing of Step S20), the CPU 106 advances the processing to Step S21. On the other hand, in a case in which the bet screen has not been detected being continuously touched by the player (in the case of a NO determination in the processing of Step S20), the CPU 106 advances the processing to Step S21.

In Step S21, the CPU 106 dynamically displays a chip so as to move along the touching path thus detected in the processing in Step S20.

In Step S22, the CPU 106 determines whether the $k+1^{th}$ bet region has been detected being touched by the player. In a case in which the $k+1^{th}$ bet region has been detected being touched by the player (in the case of a YES determination in the processing of Step S22), the CPU 106 advances the processing to Step S23. On the other hand, in a case in which the $K+1^{th}$ bet region has not been detected being touched by the player (in the case of a NO determination in the processing of Step S22), the CPU 106 advances the processing to Step S19.

In Step S23, the CPU 106 displays a chip in the $k+1^{th}$ bet region.

In Step S24, the CPU 106 stores in the memory the data indicating that a bet has been placed on the $k+1^{th}$ bet region, and advances the processing to Step S18 of FIG. 7.

Figure 9:
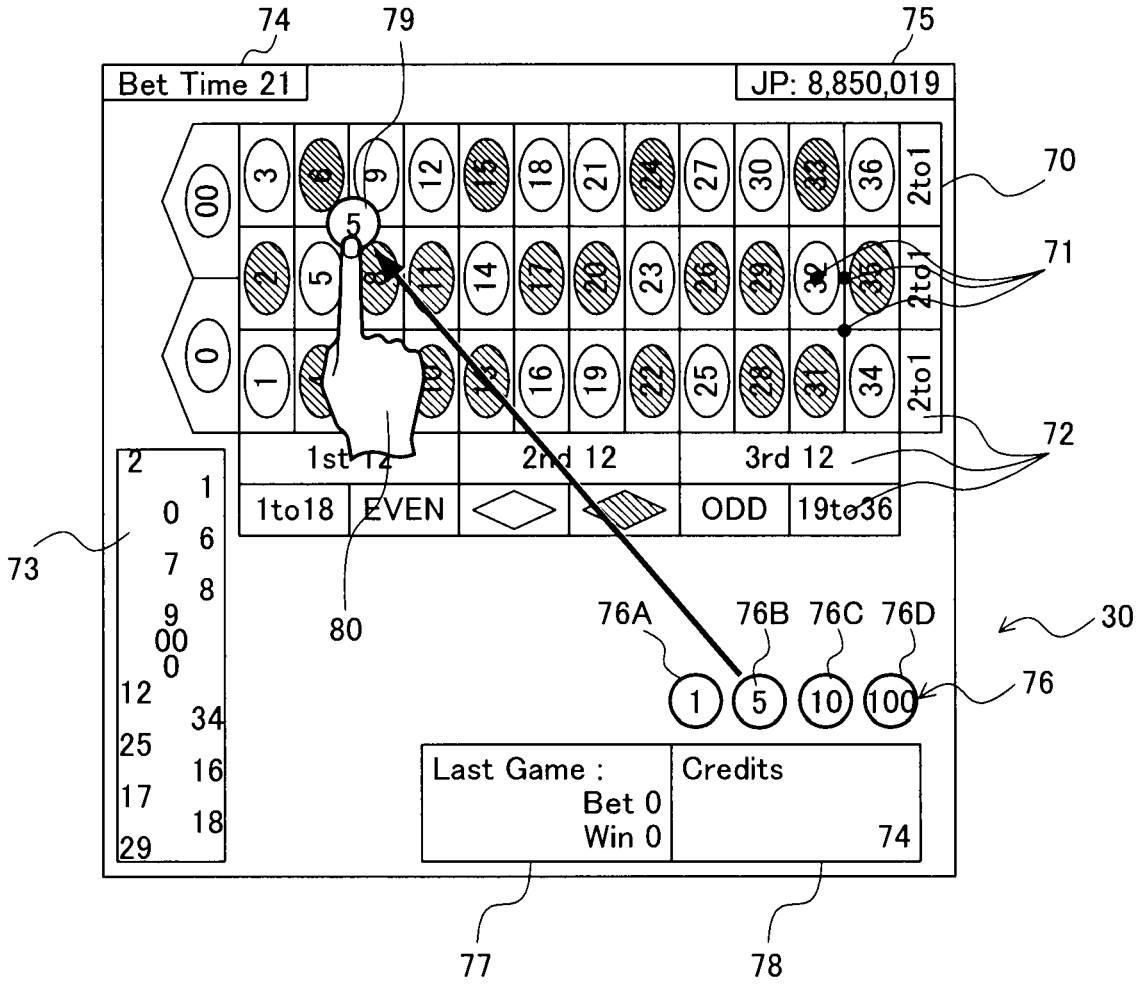
Figure 10:
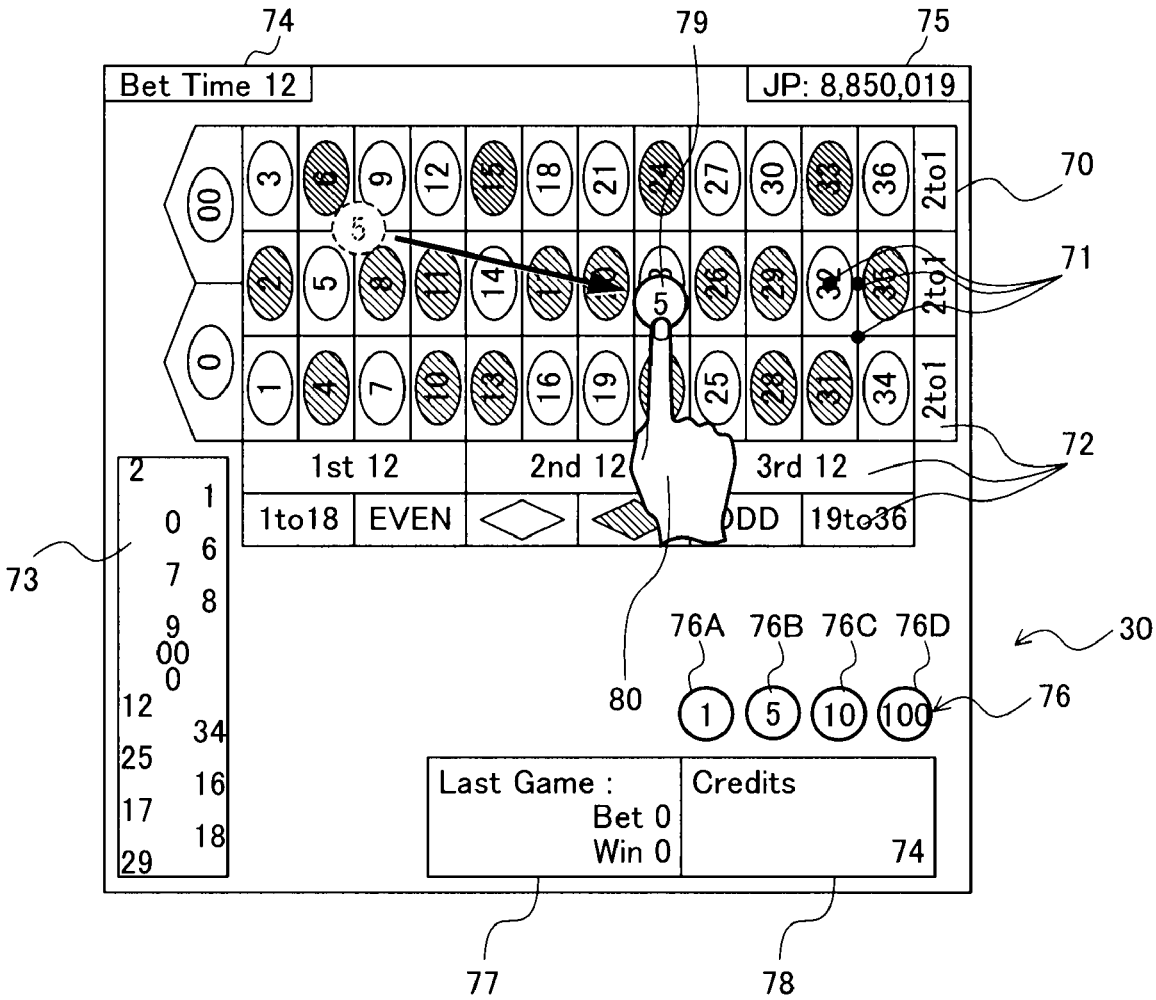

FIGS. 8 to 10 are display examples of a bet screen according to an embodiment of the present invention.

FIG. 8 is a display example of a bet screen when a player operates the start switch 25 and the liquid crystal display 30 displays a bet screen. On the liquid crystal display 30, unit bet buttons 76 of a shape similar to that of a chip are displayed. The bet buttons 76 are composed of a 1 bet button 76A, a 5 bet button 76B, a 10 bet button 76C, and a 100 bet button 76D. On the other hand, a chip is not displayed on the betting board 70. It should be noted that "30" is displayed on the bet time display unit 74 and "79" is displayed on the credit amount display unit 78.

FIG. 9 is a display example of a bet screen in which the player then touches the 5 bet button 76B among the unit bet buttons 76 and continuously touches the 5 bet button 76B from the position of the 5 bet button 76B thus touched to the intersection of the lines of the boxes of "5", "6", "8", and "9". The liquid crystal display 30 dynamically displays a chip 79 so as to move along the touching path thus detected in response to the CPU detecting the touch. Along with the dynamic display, an image of a hand 80 is displayed below the chip 79. With such a configuration, a sensation that, for example, a player actually places a bet on 4 numbers "5", "6", "8", and "9" can be obtained. It should be noted that "21" is displayed on the bet time display unit 74. Furthermore, in the present game, since a "5" chip is bet, the number displayed on the credit amount display unit 78 decreases from "79" to "74".

FIG. 10 is a display example of a bet screen in which the player touches the intersection of the lines of the boxes "5", "6", "8", and "9" and continuously touches from the intersection thus touched to the box "23". The liquid crystal display 30 dynamically displays the chip 79 so as to move along the touching path thus detected in response to the CPU 106 detecting the touch. Then, the chip 79, which had been displayed on the intersection of the lines of the boxes "5", "6", "8", and "9", becomes hidden. It should be noted that "12" is displayed on the bet time display unit 74.

FIG. 11 is a display example of a roulette game according to an embodiment of the present invention. The liquid crystal display 30 displays a state in which a ball drops in a roulette device 60 and the roulette device 60 rotates.

With such a configuration, the player can touch the chip displayed in the first bet region (for example, the intersection of the lines of the boxes "5", "6", "8", and "9"), and then move the chip once placed for betting to another bet region by touching the second bet region (for example, the box "23"). Thus, a gaming machine can be provided that overcomes trouble in an operation of moving a chip once bet to another region.

Furthermore, while the timer 113 measures 60 seconds, the player can touch a chip that is presently bet and displayed on a bet region, and then move the chip once placed for betting to another bet region by touching another bet region as many times as the player wants.

Furthermore, there is a difference in that a chip is moved artificially using the cancel button or the like, and an operation to move a chip once placed for betting to another region can be performed as if an actual chip is caused to move. Thus, a gaming machine which overcomes trouble in an operation of moving a chip once bet to another region can be provided.

Descriptions regarding the present embodiment have been provided above. In the embodiment of the present invention, although a roulette game is described as being progressed using a single gaming machine 13, as shown in FIG. 12, a roulette game may be progressed as a mass game using a plurality of the gaming machines 13.

Figure 12:
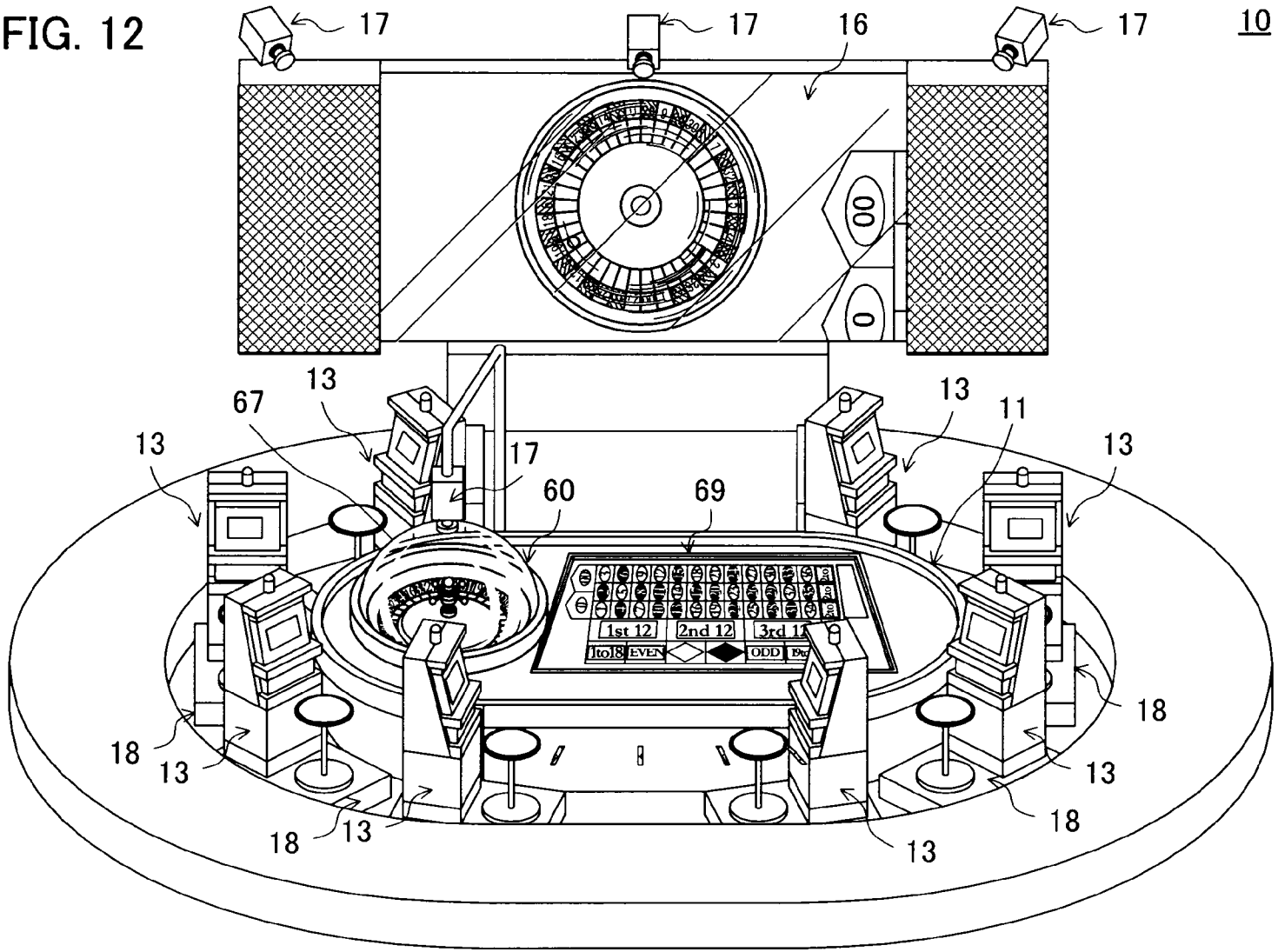
FIG. 12 is a schematic diagram showing an outer appearance of a game system configured to include gaming machines according to a modified example of the present invention.

A description is provided with respect to FIG. 12. FIG. 12 is a perspective diagram showing an outer appearance of a gaming system 10 using a plurality of the gaming machine 13. As shown in FIG. 12, the gaming system 10 includes a plurality of the gaming machines 13 and a roulette game device 11.

Furthermore, a configuration may be made so that the gaming system 10 includes a large-size monitor 16, and displays contents of the display 69 that displays a large-size betting board indicating a condition of betting of a plurality of players, a bet time indicating a remaining time in which betting is possible, winning numbers, etc. as a progress state of the roulette game on the monitor 16, along with displaying an image of the roulette wheel rotating or a picture of a player captured by the moveable viewpoint camera described later when necessary.

A plurality of the gaming machines 13 (eight gaming machines in the present embodiment) are provided so as to allow players to see the monitor 16. In addition, each gaming machine 13 and a seat 57 thereof for the player is installed on a movable floor 18, and upon a roulette game starting, a gaming machine 13 that has entered the roulette game is configured so as to be raised as one unit with the seat 57 thereof along with raising the movable floor 18.

Furthermore, the gaming system 10 includes a plurality of movable viewpoint cameras 17 (four in the present embodiment). One of the movable viewpoint cameras 17 is provided for capturing an image of a roulette device 60 described later, and captures and displayed on the monitor 16 an image of the rotating roulette wheel, and an image of a ball 65 at a certain position after the roulette wheel stops. The movable viewpoint camera 17 for capturing an image of the roulette device 60 is provided at a position that allows it to capture an image of the roulette device 60 from the viewpoint along the vertical direction from the upper side to the lower side of the roulette device 60. The movable viewpoint camera 17 for capturing an image of the roulette device 60 may capture other images before the rotation of the roulette wheel, e.g., an image of the players or an image of the display 69 for displaying the large-size betting board. The other movable viewpoint cameras 17 are installed on the upper end of the monitor 16 so as to capture a player's facial expressions. The images captured by the movable viewpoint cameras 17 are displayed on a liquid crystal display 30 of the gaming machine 13 in addition to the large-size monitor 16.

In the embodiment of the present invention, although it is configured so that a bet is placed by way of a moving operation of a finger using a touch panel even when betting a chip using the unit bet button 76, the present invention is not limited thereto. The present invention is an invention related to moving a chip once bet on the bet region 71 or 72 to another bet region, and the method whereby the initially is placed on the bet region 71 or 72 may be any kind of method. For example, a configuration may be made so that the player first designates the bet regions 71 or 72 to be bet on by directly pushing the screen with a finger or the like and, while in this state, bets chips in increments of one (the amount of chips bet is incremented in the order of "1", "2", "3", . . . , for each time the player presses the 1 bet button 76A with a finger or the like) by pressing the 1 bet button 77A. Such a configuration simplifies the operation, even when betting a great amount of chips.

Figure 13:
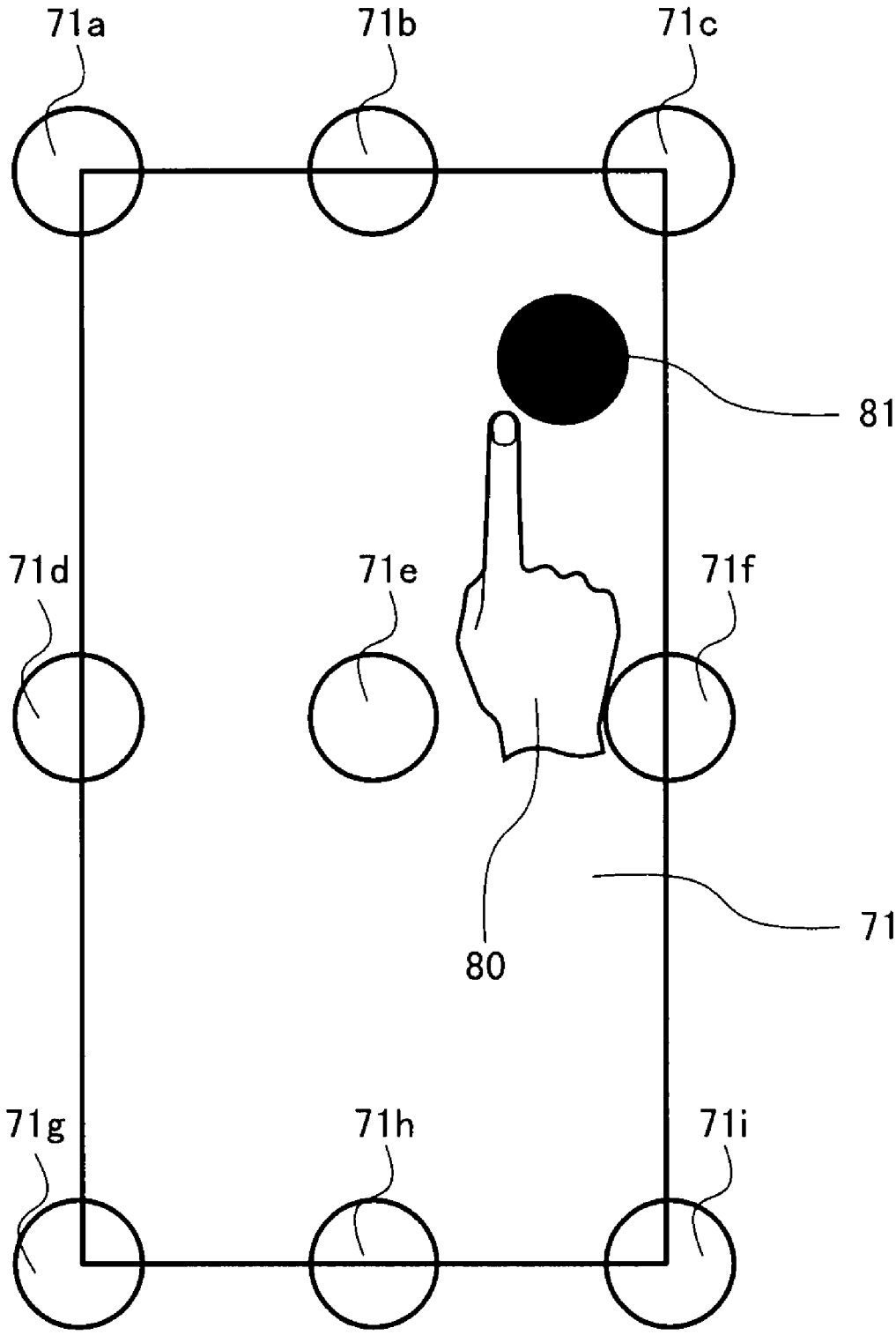
FIGS. 13 and 16 show examples of a bet screen displayed on a gaming machine according to a modified example of the present invention.
Figure 14:
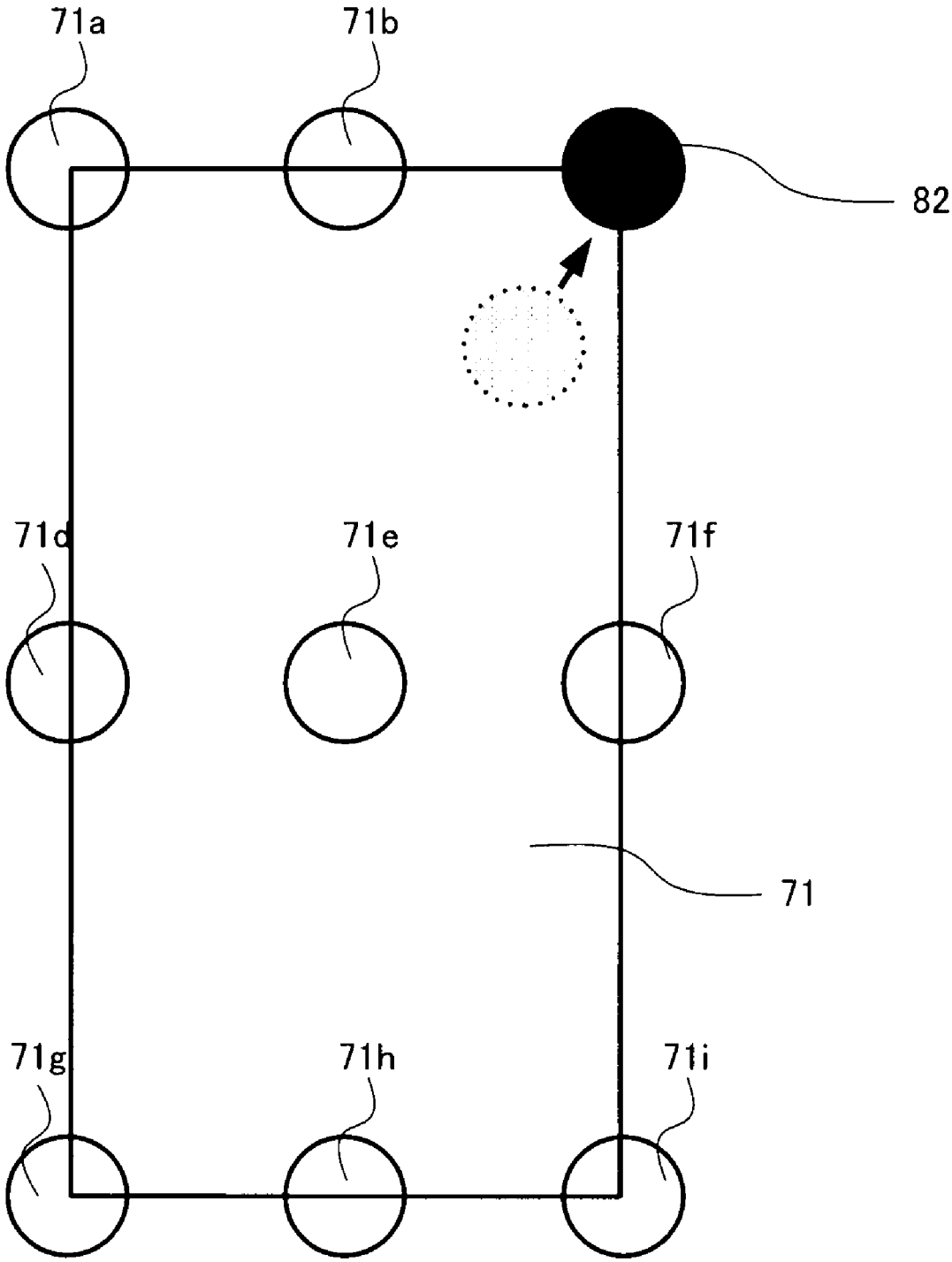

Furthermore, in the embodiment of the present invention, although a configuration is made so that a bet is performed only by touching a chip by a player, the present invention is not limited thereto. For example, as shown in FIG. 13, the bet region 71 as a single box is composed of nine bet regions 71*a* to 71*i*. It may be configured such that, in a case in which a chip 82 is moved to a position different from the positions of these nine bet regions 71*a* to 71*i*, as shown in FIG. 14, a chip 82 is moved from a position of the chip 82 thus moved to the bet region 71*c* which is the nearest thereto, without being influenced by a player's operation. Thus, the chip can be bet on a position intended by the player even without the chip being moved to an exact position.

Figure 15:
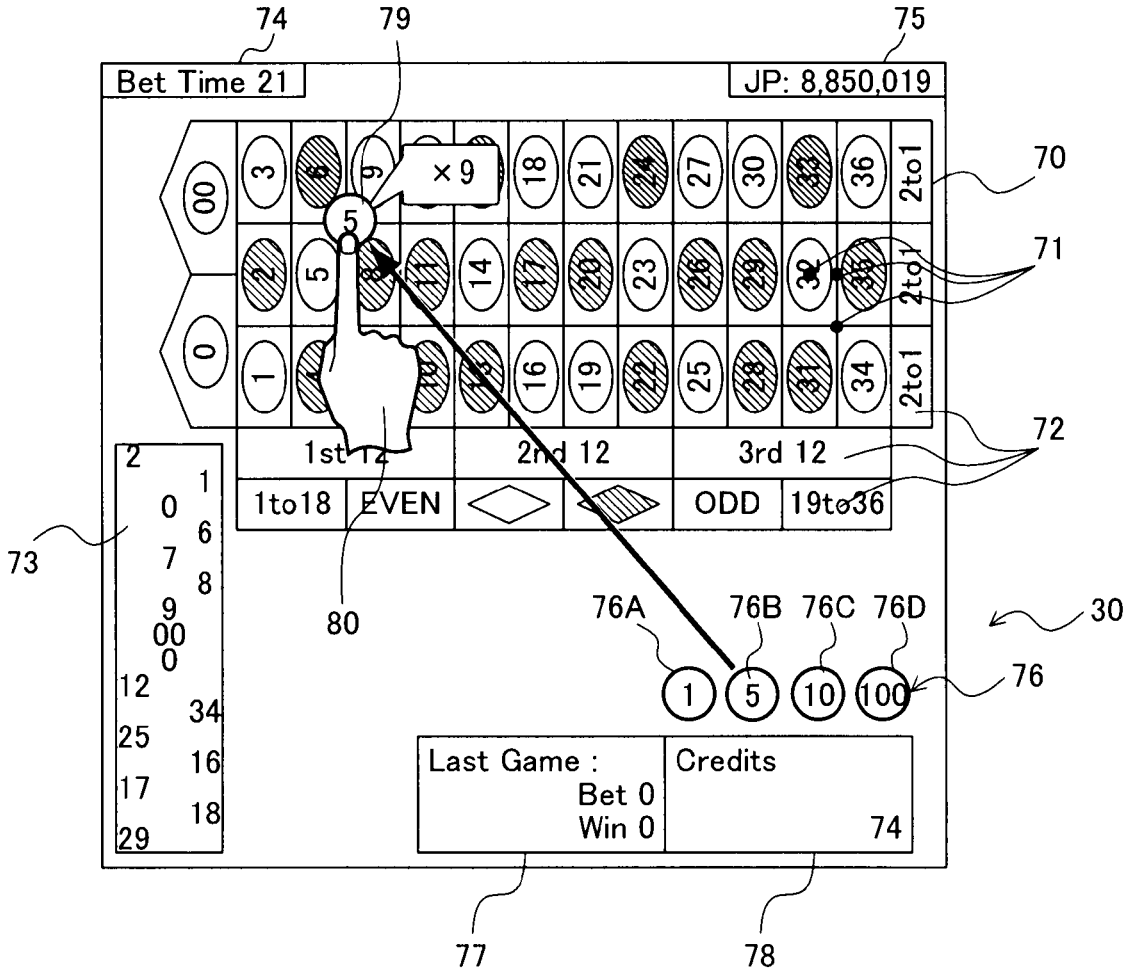
Figure 16:
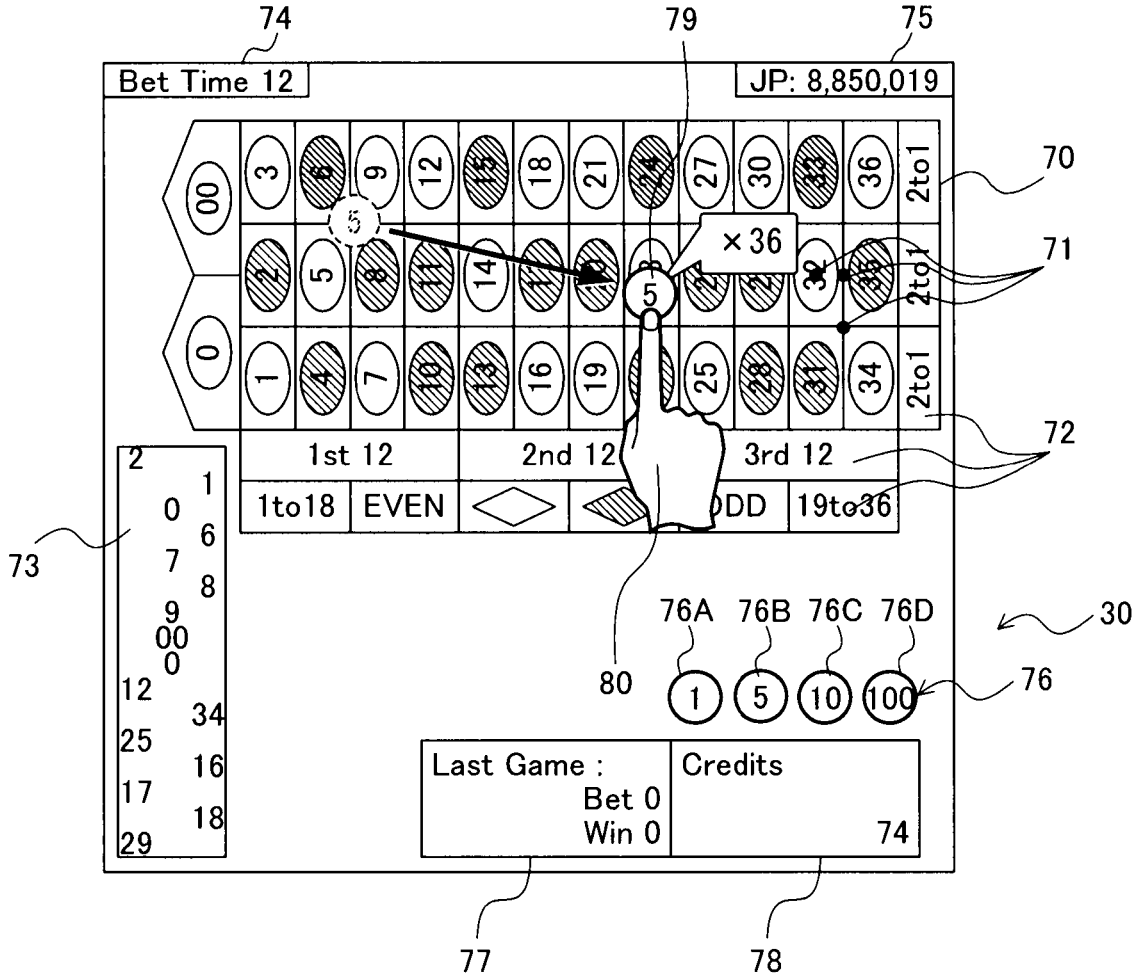

As described in FIGS. 9 and 10, in the embodiment of the present invention, although the types of chips bet and locations of the chips bet are displayed, the present invention is not limited thereto. For example, as shown in FIGS. 15 and 16, in addition to displaying the types of chips and the locations of the chips bet, awards of a location to which chips have been moved may be displayed together on the display in a popup manner. FIG. 15 corresponds to the abovementioned FIG. 9 and is a display example of a bet screen in which the player touches the 5 bet button 76B among the unit bet buttons 76 and continues to touch the 5 bet button 76B from the position of the 5 bet button 76B thus touched to the intersection of the lines of the boxes "5", "6", "8", and "9". In this case, since the chip is bet on 4 numbers, the award for it is 4/36, which is 9 to 1. Therefore, the number "×9" pops up on the chip thus bet. FIG. 16 corresponds to the abovementioned FIG. 10 and is a display example of a bet screen when the player touches the 5 bet button 76B among the unit bet buttons 76, and the player continuously touches the 5 bet button 76B from the position of the 5 bet button 76B thus touched to the box "23". In this case, since the chip is bet on a single number, the award for it is 1/36, which is 36 to 1. Therefore, the number "×36" pops up on the chip thus bet. Thus, when the player moves a chip to an arbitrary bet location, the player can visually recognize an award thereof immediately. While moving a chip, the player can always recognize the amount of an award that can be won.

Although embodiments of the present invention are described above, they are merely exemplified specific examples, and the present invention is not particularly limited thereto. Specific configurations such as each means can be modified appropriately. Moreover, it should be understood that the advantages described in association with the embodiments of the present invention are merely a listing of most preferred advantages realized by the present invention, and that the advantages according to the present invention are by no means restricted to those described in connection with the embodiments.

What is claimed is:

1. A gaming machine comprising:

a display that displays an image;

a touch panel disposed on the display;

a memory that stores data relating to a bet; and a controller that:

(a) receives an input upon activation of the touch panel;

(b) displays a plurality of bet regions on the touch panel;

(c) upon determination that the input indicates a player continuously touching a chip displayed at a first chip position from the first chip position to a first bet region among the plurality of bet regions along a first detected touching path, displays the chip on the first bet region and displays a payout rate corresponding to the first bet region on the chip that is displayed on the first bet region;

(d) stores, in the memory, data indicating that a bet has been placed on the first bet region;

(e) detects that the player has continuously touched the chip displayed on the first bet region;

(f) detects that the player has touched a second bet region along a second detected touching path;

(g) dynamically moves, upon detection that the player has continuously touched the second bet region, the display of the chip on the first bet region to the second bet region and displays a payout rate corresponding to the second bet region on the chip that is displayed on the second bet region; and (h) updates the data stored in memory to indicate that the bet has changed from the first bet region to the second bet region.

2. The gaming machine according to claim 1, further comprising:

a timer that measures a time starting from reception of a bet, wherein the controller performs (a) through (h), while the timer measures a predetermined time.

3. The game machine according to claim 1, wherein the controller displays on the display, as a popup, the payout rate corresponding to the first bet region on the chip that is displayed on the first bet region, and displays on the display, as a popup, the payout rate corresponding to the second bet region on the chip that is displayed on the second bet region.

* * * * *